US005566944A

United States Patent [19]

Anderson

[11] Patent Number: 5,566,944

[45] Date of Patent: Oct. 22, 1996

[54] GAME APPARATUS

[76] Inventor: Richard M. K. Anderson, 6 Tuhoe Avenue, Whakatane, New Zealand

[21] Appl. No.: 524,983

[22] Filed: Sep. 8, 1995

Related U.S. Application Data

[63] Continuation of Ser. No. 174,832, Dec. 29, 1993, abandoned.

[51] Int. Cl.[6] ..... A63F 3/00

[52] U.S. Cl. ..... 273/242; 273/260; 273/290

[58] Field of Search ..... 273/236, 242, 273/243, 255, 261, 260, 262, 241, 290

[56] References Cited

U.S. PATENT DOCUMENTS

| | | | |
|---|---|---|---|
| 2,066,244 | 12/1936 | Bates | 273/260 |
| 3,155,391 | 11/1964 | Chittenden | 273/262 X |
| 3,455,555 | 7/1969 | De Bono | 273/242 |
| 3,869,124 | 3/1975 | Stein et al. | 273/206 X |
| 3,871,657 | 3/1975 | Lorenz et al. | 273/260 X |
| 4,079,941 | 3/1978 | Morales | 273/260 |
| 4,150,828 | 4/1979 | Marchese | 273/260 |
| 4,583,742 | 4/1986 | Slinn | 273/260 |

FOREIGN PATENT DOCUMENTS

| | | | |
|---|---|---|---|
| 2218646 | 11/1989 | United Kingdom | 273/260 |

*Primary Examiner*—William E. Stoll
*Attorney, Agent, or Firm*—Blakely Sokoloff Taylor & Zafman

[57] ABSTRACT

A game apparatus comprising a board having a pattern of regularly shaped areas marked thereon. The areas are denoted by coding such that there is one set of areas distinguishable from at least another set of areas. The game apparatus further includes sets of playing pieces there being a set of playing pieces for each set of areas. The playing pieces are multi-faceted and are of various shapes with the faces of the playing pieces being each of a shape which is commensurate with the shape of an area. Accordingly when a playing piece is located on the board it covers two or more of the areas with the playing pieces being able to stack upon each other on the board with at least some of the playing pieces in each set having a multi-faceted projecting portion.

5 Claims, 4 Drawing Sheets

GAME APPARATUS

This is a continuation of application Ser. No. 08/174,832 filed Dec. 29, 1993, now abandoned.

BACKGROUND OF THE INVENTION

DISCUSSION OF THE BACKGROUND

This invention relates to a game apparatus.

SUMMARY OF THE INVENTION

Broadly the game apparatus comprises a board having a grid-like pattern of regularly shaped areas marked thereon, said areas being denoted by coding means such that there is one set of areas distinguishable from at least one other set of areas; the apparatus further includes sets of playing pieces there being a set of playing pieces for each set of areas, said playing pieces being multi-faceted and of various shapes, the faces of the playing pieces being each of a shape which is commensurate with the shape of a said area such that when a playing piece is located on the board it covers two or more of said areas said playing pieces being able to stack upon each other on the board with at least some of the playing pieces in each set, having a multi-faceted projecting portion.

Preferably each set includes at least one playing piece which has a surface with which another playing piece cannot engage.

In the preferred form of the invention the areas are squares.

DESCRIPTION OF THE PREFERRED EMBODIMENTS

Figure 1:
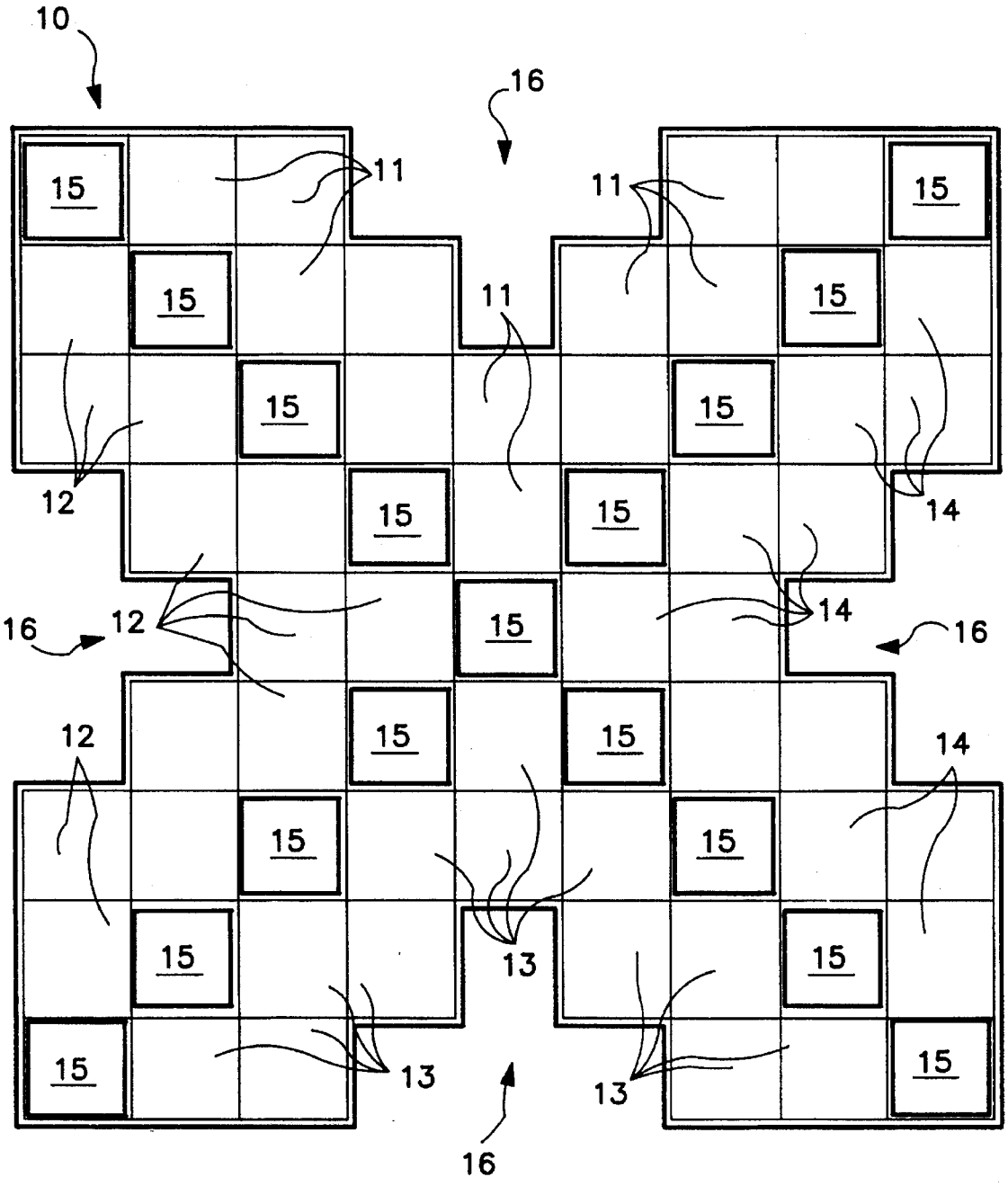
FIG. 1 is a plan view of one form of a board in accordance with the invention.

The board and the playing pieces can be constructed of any suitable material but it is envisaged that the game apparatus lends itself to being manufactured from wood. Equally, however, the board can be of conventional cardboard construction with the playing pieces moulded from a plastics material. Alternatively the board can be constructed from wood and the playing pieces from plastics material.

The board 10 is marked with a grid-like pattern of regularly shaped areas which according to the preferred form of the invention are squares. The board as illustrated in the drawings is designed for use by up to four players. Accordingly there are sets 11, 12, 13 and 14 of squares with the sets of squares being distinguishable one from the other by suitable coding means. In the simplest form of the invention each set of squares is colour coded.

According to the preferred form of the invention these sets of areas 11, 12, 13 and 14 are separated by a plurality of neutral squares 15 which are coloured differently to any of the colours used for sets 11–14.

To distinguish these neutral squares in FIG. 1 from the other squares 11–14, the squares 15 are represented by a double line.

Also according to the preferred form of the invention there are indented areas 16 which carry no markings. Generally the board will be straight sided thus indented areas 16 will essentially be blank areas on the board.

For each player there is a set of playing pieces with each playing piece being coded in the same manner as the corresponding set of squares. Once again in the preferred form of the invention the coding is achieved by the playing pieces being coloured in the same manner as the set of squares to which they relate.

Figure 2:
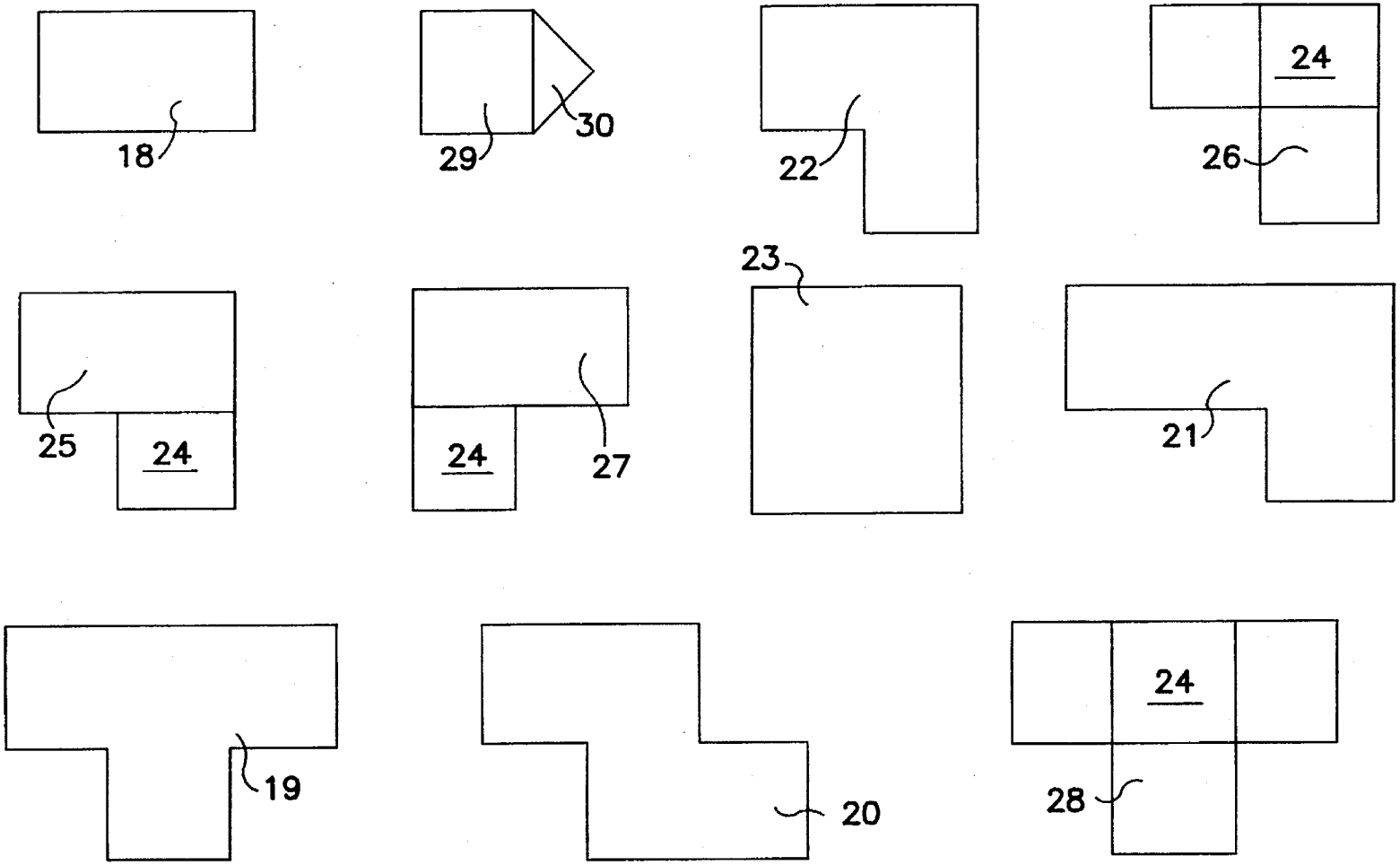
FIG. 2 is a plan view of a plurality of playing pieces.

In FIG. 2 of the drawings there is illustrated a typical set of playing pieces though it will be realized that in each set there will be a duplication of at least some of the playing pieces.

Each playing piece has a shape when viewed in plan provides a first surface which enables the playing piece (except for the "capping" piece described later) to be placed on the board such that the first surface spans and covers at least two of the squares on the board. Thus, for example, playing piece 18 is of a length equal to two squares. Playing piece 19 is of generally T shape with the stem of the T being one square long and the cross piece being three squares long. In a similar manner Z shaped playing piece 20 has two legs each of a length two squares long while L shape playing piece 21 has the stem portion three squares long and the foot portion one square long.

The playing pieces described above and playing pieces identified as 22 and 23 in FIG. 2 are of all uniform thickness or depth (see for example playing piece 22 in FIG. 3) thus providing a second surface which is parallel to the first surface. The thickness of the playing piece is equal to the side dimension of the squares marked on the playing board. Thus the playing pieces can be stacked upon one another on the board and snugly interfit.

Figure 3:
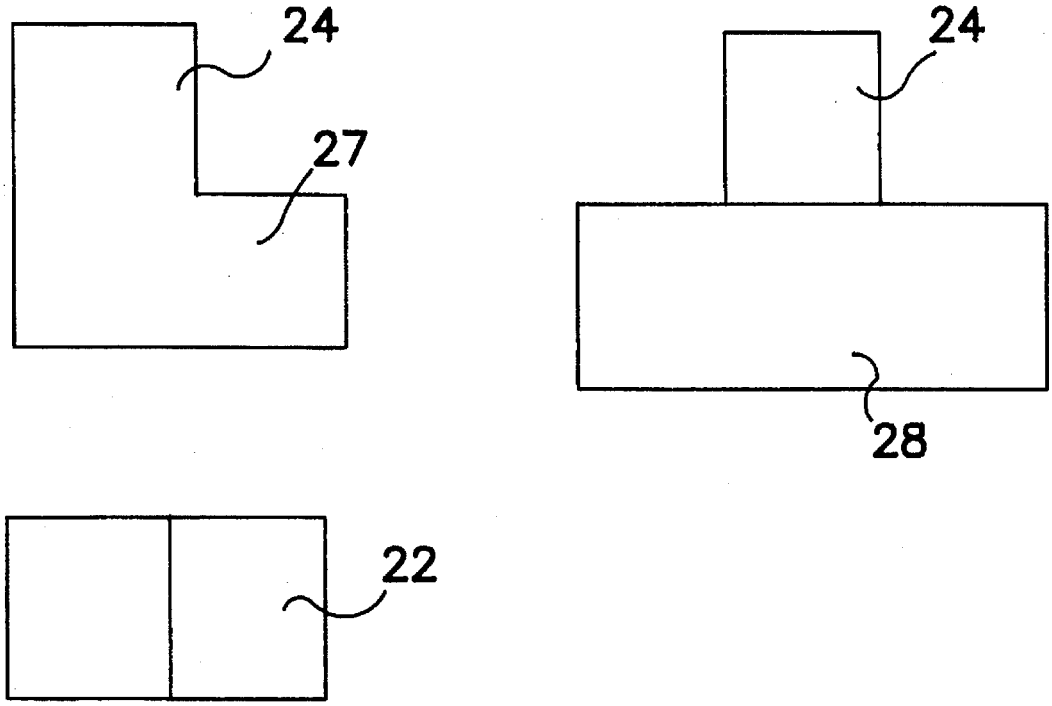
FIG. 3 shows side elevation views of some of the playing pieces illustrated in FIG. 2.

However, at least some of the playing pieces have projecting portions 24 such playing pieces with the projecting portions 24 providing a third surface located parallel to the first and second surfaces thereof. The projecting portion 24 results in the second surface of the playing piece being less than the first surface thereof. Such playing pieces being identified at 25, 26, 27 and 28 in FIG. 2. Playing pieces 27 and 28 are further illustrated in. FIG. 3 which shows that projecting portions 24 are essentially cubic in shape with the faces thereof being commensurate with the dimensions of the squares marked on the playing board. Thus once again these playing pieces can be placed on the board and also stacked on other playing pieces to interfit therewith.

To play the game a player selects a particular set of playing pieces. With the board as illustrated two to four players can play. Each player in turn places a playing piece on the board or on playing pieces already on the board. The player must, however, place his or her playing piece such that it covers or locates over at least one square or the area of a playing piece equivalent to a square of the same colour as the colour of the player's playing pieces. The player is not restricted as to which type of playing piece he or she uses. Provided that the playing/piece covers or locates over a same coloured square or area of a previously played playing piece the rest of the playing piece can cover a neutral square or other coloured square or area of a playing piece.

Each set of playing pieces preferably has one or more "capping" pieces (see playing piece 29 in FIG. 2). The capping piece 29 has a base equal in shape and area to at least one of the squares. This playing piece includes a projecting portion 30 which is so shaped that another playing piece cannot fit or sit thereon. During the game a player may place a capping piece on any colour and this thereby prohibits anyone from building on the particular square or part of a playing piece on which the capping piece has been placed. The capping piece is neutral and does not count as being "owned" by any player.

During play the playing pieces must stay within the marked border of the board 10 at all stacked levels above the surface of the board.

During the game it may be possible that there are no more squares (either formed by the board or a previously played playing piece) of the colour of a particular player. This player is then said to have been "topped out" and takes no further part in the game including playing of capping pieces. At the end of the game when either no players can take their turn because of either being "topped out" or having no playing pieces the game is deemed to be over and the winner is the player having the highest playing piece. That is the playing piece which is or has a part thereof located at a level above the board higher than any other playing piece or part thereof.

Figure 4:
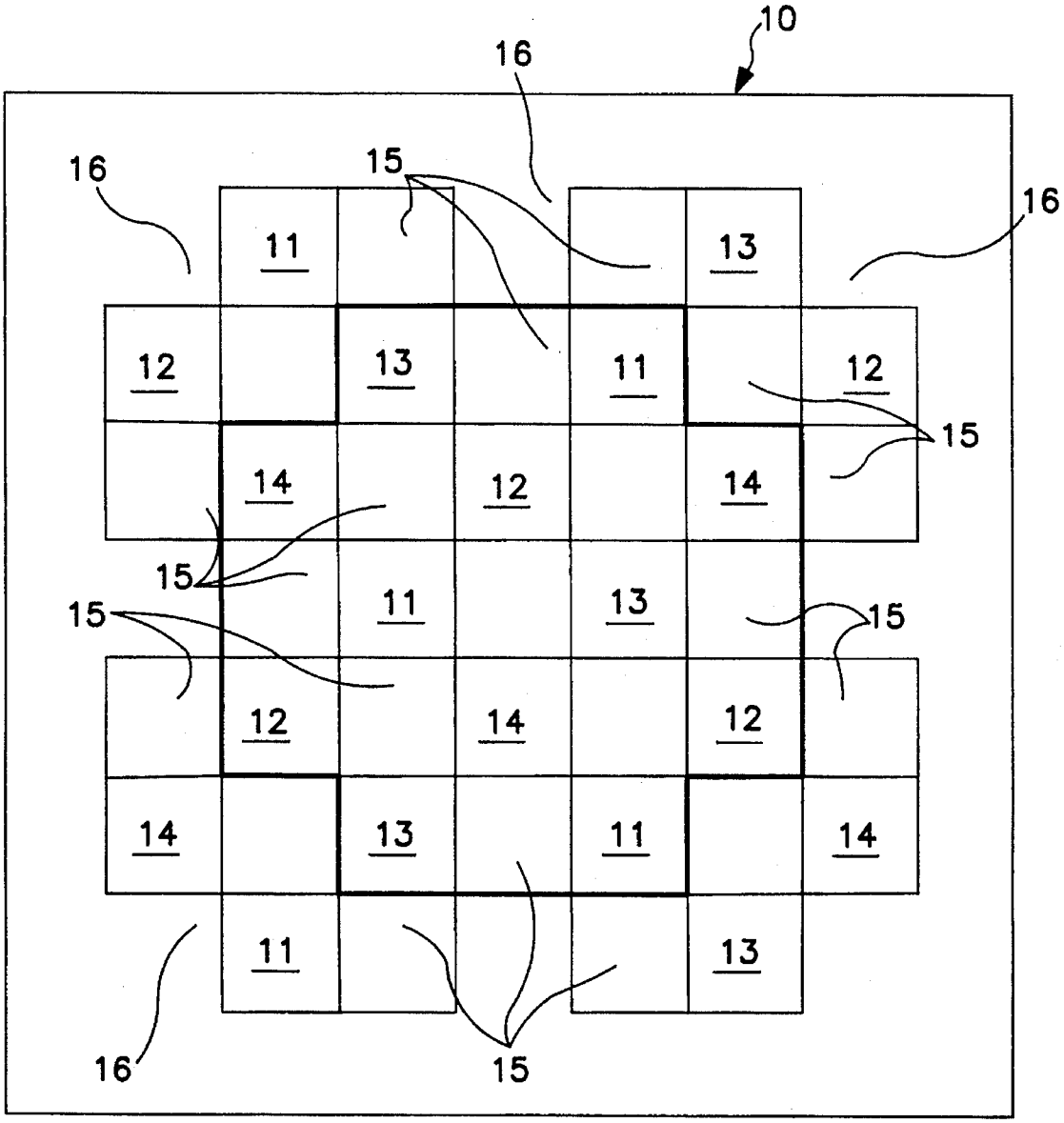
FIG. 4 is a plan view of a second form of board in accordance with the invention.

The game is open to modification. For example, the board does not need to have the coloured squares grouped together in their own colours (see FIG. 4). Indeed a board for three players preferably has the coloured squares interspersed over the entire surface of the board so that one player is not disadvantaged relative to the other two players as can be the case when three players use the board as illustrated in FIG. 1. With the arrangement shown in FIG. 4 the part of the board used for two or three players is that part shown by thickened line L.

Also the marked areas do not need to be squares but could be of other shapes. Also the various shapes of the playing pieces can include shapes other than those illustrated.

The indent areas 16 shown on the playing board perform a function rather than being provided for aesthetic purposes. By having these areas in which players cannot place part of a playing piece the players are naturally forced to place the playing pieces so that the "construction" moves toward the centre of the board. This prevents a player from creating a structure adjacent a border of the board and not having to inter-engage his or her playing pieces with other colours and thereby make it difficult for other players to restrict the height of the construction.

The game apparatus enables a game which is simple to play yet involves the levels of strategy, awareness and thought which add to the pleasure and excitement of the game.

What is claimed is:

1. A game apparatus comprising a board having a pattern of equal sized squares marked thereon, said squares being denoted by coding means such that there is one set of squares distinguishable from at least one other set of squares; the apparatus further includes sets of playing pieces, there being a set of playing pieces for each set of squares, said playing pieces being multi-faceted and of various shapes, each playing piece having a first surface of an area such that, when the playing piece engages the board at the first surface, the first surface covers a plurality of squares, each playing piece further having a second surface of the same area and shape as the first surface, said second surface parallel to and located above the first surface, said first and second surfaces being spaced apart by a distance equal to the length of the side of one of said squares; each set of playing pieces further including at least one capping playing piece having a base equal in area and shape to one of said squares, said capping playing piece having an upward projection so that another playing piece is not permitted to engage the capping playing piece during playing of the game, further wherein the playing pieces that are not capping pieces are adapted to vertically engage other playing pieces.

2. The game apparatus as claimed in claim 1 wherein the sets of areas are distinguishable from one another by colour coding.

3. The game apparatus as claimed in claim 2 wherein the board also includes areas which are coded so as to be distinguishable from the sets of areas which correspond to the sets of playing pieces.

4. The game apparatus as claimed in claim 3 wherein the periphery of said pattern of squares includes a plurality of spaced apart indented areas which carry no coding and during play are areas on which playing pieces are not permitted to be placed on or over.

5. A game apparatus according to claim 1, further wherein each set of playing pieces has a subset of playing pieces with a third surface parallel to the second surface and spaced above the first surface by a distance equal to twice the length of one of said squares, said third surface having an area less than the second surface but equal to at least one or more of said squares, and wherein said third surface has a shape composed of at least one or more of said squares.

* * * * *

UNITED STATES PATENT AND TRADEMARK OFFICE

CERTIFICATE OF CORRECTION

PATENT NO. : 5,566,944

DATED : October 22, 1996

INVENTOR(S) : Anderson

It is certified that error appears in the above-identified patent and that said Letters Patent is hereby corrected as shown below:

In column 2 at line 33, please delete " to " and insert -- to but spaced from --.

Signed and Sealed this

Twelfth Day of August, 1997

Bruce Lehman

*Attest:*

BRUCE LEHMAN

*Attesting Officer*

*Commissioner of Patents and Trademarks*